US010028560B2

(12) United States Patent
Simmons

(10) Patent No.: US 10,028,560 B2
(45) Date of Patent: Jul. 24, 2018

(54) WALLET ACCESSIBILITY AID AND ORGANIZING APPARATUS

(71) Applicant: Charmaine Simmons, Jacksonville, FL (US)

(72) Inventor: Charmaine Simmons, Jacksonville, FL (US)

( * ) Notice: Subject to any disclaimer, the term of this patent is extended or adjusted under 35 U.S.C. 154(b) by 0 days.

(21) Appl. No.: 15/183,176

(22) Filed: Jun. 15, 2016

(65) Prior Publication Data

US 2017/0039897 A1 Feb. 9, 2017

Related U.S. Application Data

(60) Provisional application No. 62/202,586, filed on Aug. 7, 2015.

(51) Int. Cl.

| | |
|---|---|
| ***A45C 11/18*** | (2006.01) |
| *G09F 3/02* | (2006.01) |
| *A45C 1/06* | (2006.01) |

(52) U.S. Cl.

CPC ..... *A45C 11/182* (2013.01); *A45C 2001/065* (2013.01); *G09F 2003/023* (2013.01); *G09F 2003/0208* (2013.01); *G09F 2003/0279* (2013.01)

(58) Field of Classification Search

CPC .. B42F 21/02–21/10; G09F 2003/0279; G09F 3/10; B42D 25/30; B42D 25/22; A45C 2001/065; A45C 11/182

See application file for complete search history.

(56) References Cited

U.S. PATENT DOCUMENTS

| | | | | |
|---|---|---|---|---|
| 5,283,091 | A * | 2/1994 | Darvell | G09F 3/10 283/37 |
| 6,427,836 | B1 * | 8/2002 | Bolanos | A45C 11/182 150/148 |
| 8,434,803 | B1 * | 5/2013 | An | B25J 1/04 294/212 |
| 8,776,846 | B1 * | 7/2014 | Thompson | A45C 11/182 150/138 |
| 2003/0232190 | A1 * | 12/2003 | O'Leary | B32B 7/02 428/343 |
| 2010/0127225 | A1 * | 5/2010 | Mika-Duesler | A45C 11/182 254/1 |
| 2010/0139138 | A1 * | 6/2010 | Miadich | A45C 11/182 40/641 |
| 2011/0072701 | A1 | 3/2011 | Lemna | |

(Continued)

*Primary Examiner* — Charles A Fox
*Assistant Examiner* — Christopher E Veraa
(74) *Attorney, Agent, or Firm* — Michael L. Greenberg, Esq.; Greenberg & Lieberman, LLC

(57) ABSTRACT

A wallet organization system and apparatus relating to wallet card differentiating tabs is disclosed. The tabs are configured to adhere to conventional cards contained in wallets with at least one adhesive surface. The tabs are equipped with a label which may be customized via included personalization, as well as a variety of colors, helping users rapidly differentiate between layered cards in a wallet, and provide for easy removal of the target card in need of removal from the wallet for use. A bendable portion of the tabs facilitates the use of wallet cards within magnetic strip readers and ATMs without removal of the tabs from the cards. The adhesive is configured to be reusable and durable.

12 Claims, 5 Drawing Sheets

(56) References Cited

U.S. PATENT DOCUMENTS

| | | | | |
|---|---|---|---|---|
| 2011/0162766 | A1* | 7/2011 | Paulsen | A45C 11/182<br>150/147 |
| 2011/0253297 | A1* | 10/2011 | O'Keefe | B42D 5/027<br>156/230 |
| 2012/0248756 | A1* | 10/2012 | Still | B42F 21/04<br>283/81 |
| 2013/0049348 | A1* | 2/2013 | Lemna | B24F 21/04<br>283/67 |
| 2013/0093177 | A1* | 4/2013 | Nena | B42D 15/00<br>283/81 |
| 2013/0170938 | A1 | 7/2013 | Lowden | |
| 2014/0034227 | A1* | 2/2014 | Segui | B65C 1/04<br>156/249 |
| 2014/0203581 | A1* | 7/2014 | Baker | A45C 1/00<br>294/137 |
| 2014/0262852 | A1* | 9/2014 | Gourdine | B32B 37/185<br>206/39 |
| 2016/0198839 | A1* | 7/2016 | Jamison | A45C 1/06<br>294/156 |

* cited by examiner

WALLET ACCESSIBILITY AID AND ORGANIZING APPARATUS

CONTINUITY

This application is a non-provisional application of provisional patent application No. 62/202,586, filed on Aug. 7, 2015, and priority is claimed thereto.

FIELD OF THE PRESENT INVENTION

The present invention relates to personal wallet organization, and more specifically relates to a wallet organizing system configured to expedite a user's removal of cards from the wallet with ease.

BACKGROUND OF THE PRESENT INVENTION

Conventionally, wallets for men and women are equipped with at least one card slot configured to hold personal cards such as credit cards, identification cards, bank cards, insurance cards, business cards, and other cards. It is common for wallets to have between 4 and 10 of such card slots, so as to provide independent slots for up to 10 cards. Individuals needing to carry more cards than the wallet has slots are forced to carry two or more cards in each of the card slots, adding bulk and disorganization to the wallet. This method often leaves only the tip of one of the cards within the card slot partially visible, obscuring the second (and potentially third) card behind the visible card within the card slot.

Unfortunately, when rapid removal of a specific card is required, such as at a point-of-sale terminal, many users experience difficulty locating and easily removing the needed card. Commonly, users must pull out several cards in order to determine if the card pulled is the desired card needed at the time. This is especially true for individuals carrying multiple cards in each card slot of the wallet, as they must partially remove the cards from the card slot in order to determine which card is behind the visible card. Location and identification of the correct card can quickly become cumbersome, such as in cases where the card slots of the wallet are very tight, there are multiple cards in each card slot, the individual is elderly, or if the individual has large fingers.

Additionally, it can be difficult to locate and identify the target card in an individual's wallet in a dark room setting or at night while outdoors. This can be especially troublesome in a dark nightclub, bar, theatre vendor, or other dark location. If there were a way to rapidly locate, identify, and employ wallet cards in the dark without a struggle, users would have an easier time paying for items in the dark.

Thus, there is a need for a new wallet organization apparatus configured to facilitate and expedite the location, identification, and removal of the desired card from the card slot of a wallet, minimizing frustration of the individual, and making the check-out process a less cumbersome experience. Such an apparatus is preferably equipped with glow-in-the-dark elements that facilitate the location, identification, and use of a wallet card while in the dark.

Few instances in the prior art attempt to address this issue without attempting to reinvent the wallet itself. While there are many advanced wallets on the market, including those with card slots equipped with switches or lever to eject the desired card, no other wallet aid employs the user's existing wallet, without modification, to achieve the desired result.

Relevant instances found in the prior art include patent no. US 20130093177 A1, "Credit Card Self-Adhesive Pull Tab and Method of Using the Same" which discloses a uniquely identifiable self-adhesive pull tab that can be attached to the card. The uniquely identifiable self-adhesive pull tab includes, but is not limited to, a plastic tab comprising a plurality of sections, and a fold line. In a preferred embodiment, the plastic tab contains approximately four equally sized sections, two on either side of the fold line. The sections immediately adjacent to the fold line do not contain any adhesive coating. However, each of the remaining sections contains an adhesive coating on one side, respectively, which will meet when the self-adhesive pull tab is folded upon use. The self-adhesive pull tabs of the present invention can be made of different colors, have numbers or letters on outside of the non-adhesively coated sections when folded, or contain other uniquely identifiable characters. Unlike, in the current invention the tab is a single film and can also be used for wallet photos in wallet or in notepads, organizers, daily planners, photo albums and briefcase.

Another instance in the prior art that is similar to, yet varies from the present invention includes U.S. Patent No. US 20130170938 A1, for an "Apparatus and method for assisting the retrieval of identification or credit cards from a wallet," which discloses an apparatus and method of efficiently locating and extracting a card such as an identification, membership, or banking card from a wallet, purse, or other card carrying device. The apparatus features a coupling implement and a gripping terminus. The various gripping termini depict a visually distinct ornamental shape including a heart, a strawberry, a bag of money, a flower, trademarks and/or logos. The gripping terminus is oriented such that it is visible above the edge of the card so that when the card is inserted into a pocket or sleeve the gripping terminus will remain visible. An individual may easily extract cards by gently pulling the gripping terminus in the desired direction. Unlike, the current invention provides a tab which can be removed, repositioned and bent for organizing, removal and use of the items in wallets, daily planner, photo albums etc.

Another relevant prior art is Patent No. US 20110072701 A1, for a "Tab assembly for a card." The application discloses a tab assembly including two opposable tabs hingedly attached to an indicia member. The opposable tabs can be coated with a pressure sensitive adhesive on adjacent surfaces. When the opposable tabs are coated with a pressure sensitive adhesive, the tab assembly can be located directly at a desired location and pressure can be applied to the surfaces of the tabs to adhere the tab assembly at the desired location. For example, the tab assembly can be located at the surface of the card and pressure applied to the surfaces of the tabs to adhere the tab assembly to the surface of the card. In yet other embodiments the card can be a credit card, a photograph, a driver's license, a debit card, a business card, etc. An indicia member such as a color, a sign, a symbol, a trademark, a number, a letter, a design, other distinguishing marks, extends from the surface of the object to which it is adhered to allow for visibility and ease of access of the particular item for grasping. This is unlike the present invention, as conversely, the tab is a single thin plastic film having adhesive on the rear for attaching to cards and other items for easy gripping and removal of these cards/items from wallet. Additionally, the present invention is formed in unique shapes to facilitate location and access of a user's cards.

SUMMARY OF THE PRESENT INVENTION

The present invention is wallet card identification assistance aid apparatus configured to enable an individual to rapidly identify his or her cards within conventional card slots of a wallet, quickly differentiate between similar cards, remove the target card with ease, and reduce the time spent at a point-of-sale terminal. The present invention is a system employing personalized tabs which are configured to adhere to an individual's cards, readily facilitating the differentiation of cards in one's wallet. The tabs of the present invention employ an adhesive, and may be personalized according to the user for use on ATM debit cards, credit cards, ID cards, gift cards, and business cards or photos. The present invention is envisioned for use on all styles of wallets. The tabs facilitate the easy removal of wallet cards by finger grip, as each of the tabs is preferably equipped with ribbed edges disposed on the tips of the tab area. In some embodiments of the present invention, the tip and bod of the tabs illuminate (via a glow-in-the-dark substrate) which helps users to easily identify the tabs in dark settings, such as outdoors or in a dark room, such as a bar or nightclub.

Unique aspects of the present invention include, but are not limited to:

- The present invention attaches to ID cards, credit/debit cards, and wallet photos to be placed in the wallet, facilitating easy removal of the cards from the wallet by pulling on the tab. The use of the present invention in this manner is especially helpful to handicapped individuals with disability in their hands, elderly people, individuals with carpal tunnel syndrome, individuals missing digits, and individuals with large hands and fingers.
- The present invention is equipped with adhesive on the rear, allowing the tab to attach to the target wallet card.
- The present invention is preferably designed in multiple colors, as well as in custom designs including adhesive letters, names, initials, numbers, dates, and design logos to personalize the tab.
- The preferred embodiments of the present invention are available in three sizes—a small Swiper tab (for attaching to ATM debit/credit cards), a larger Big Buddy tab (for business cards, ID cards, Photographs, other cards that need not be swiped frequently in a magnetic strip reader), and a Tight-Fit tab with a smaller profile configured for use in card slots with minimal spacing.
- The tabs of the present invention may be removed, repositioned and also bent for swiping the debit/credit cards on transaction machines.
- The present invention is configured to be used in trifold, bifold, secretary, hipster, key wallet, zipper wallet and accordion style wallets.
- The present invention may also be used with notepads, organizers, daily planners, photo albums and briefcase elements.
- The present invention is preferably made of a thin plastic film material.
- The tabs are equipped with ribbed tip surfaces that make gripping the tabs with a finger easier.
- The tabs of the present invention may be equipped with illuminating surfaces (equipped with glow-in-the-dark paint or other substrate) that make the tabs glow in dark settings.

BRIEF DESCRIPTION OF THE DRAWINGS

The present invention will be better understood with reference to the appended drawing sheets, wherein.

DETAILED DESCRIPTION OF THE PREFERRED EMBODIMENT

Figure 1:
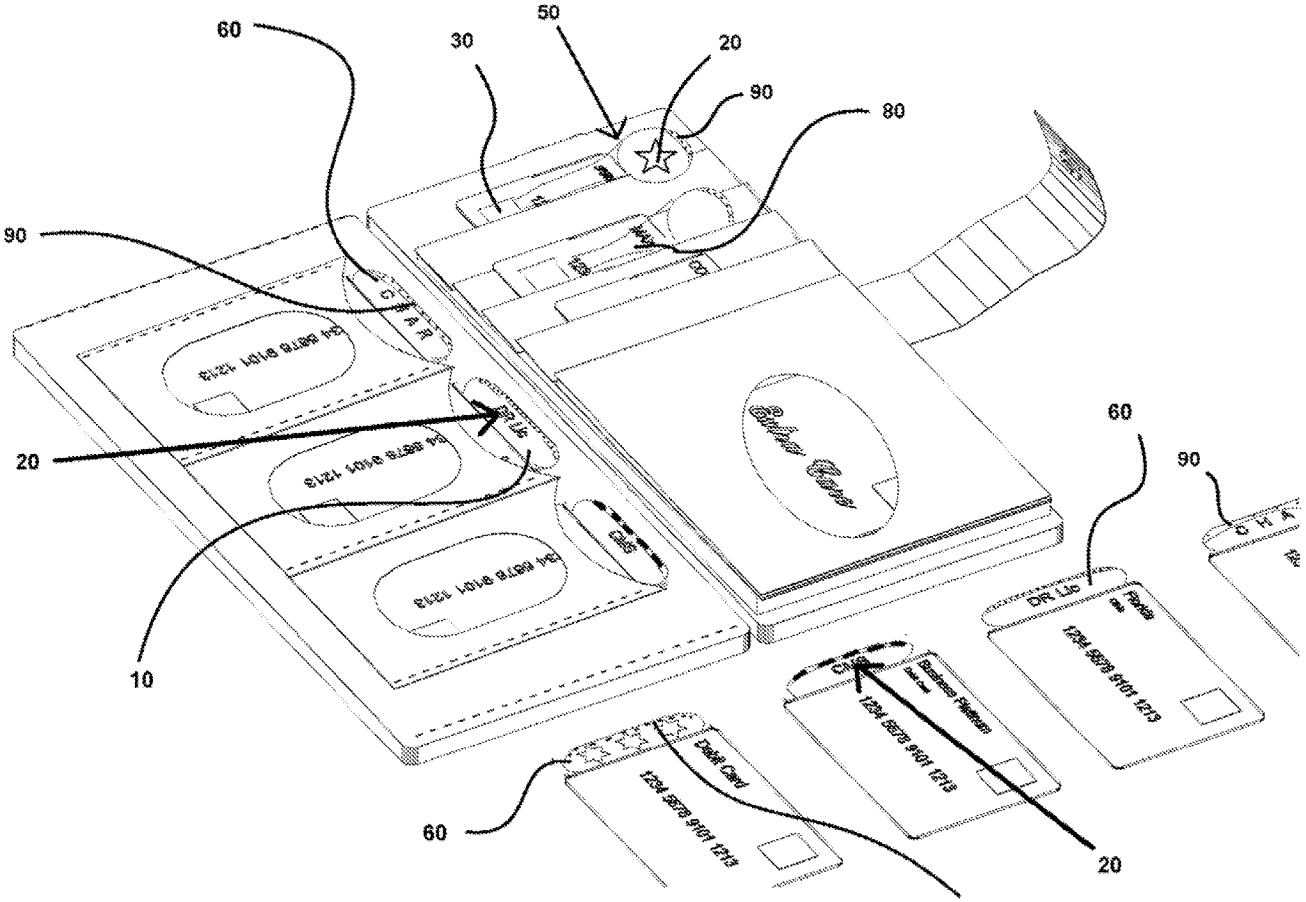
FIG. 1 displays a view of the preferred embodiment of the present invention as seen from the side, detailing the profile of the Swiper Tab and Big Buddy Tab of the present invention as installed on cards within a conventional bi-fold wallet.
Figure 2:
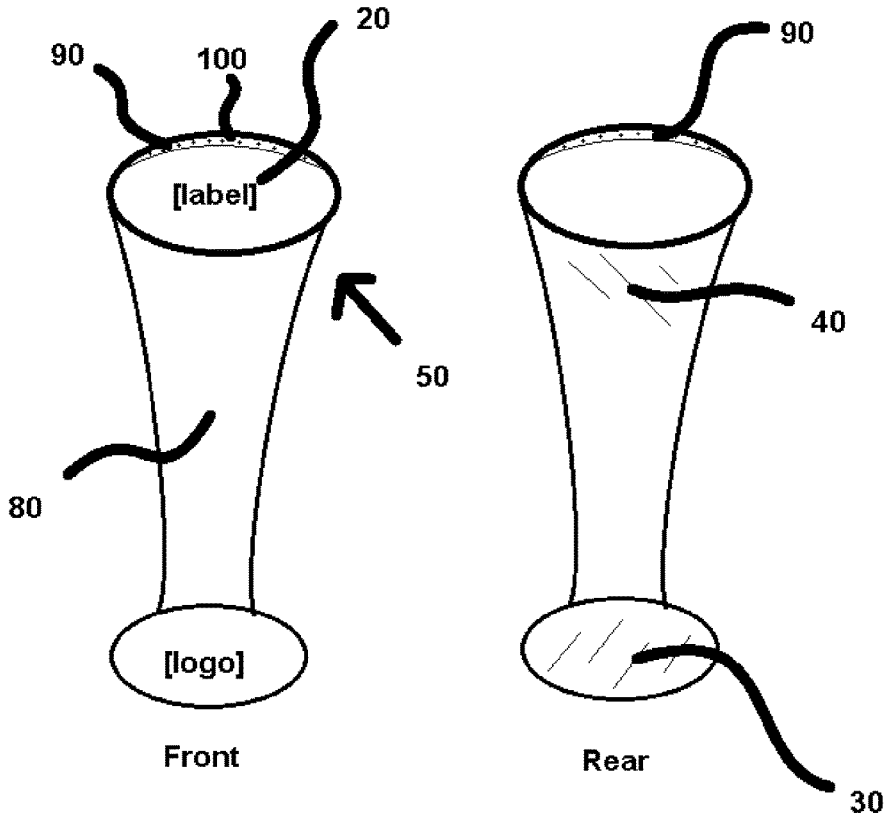
FIG. 2 shows a close up view of the Swiper Tab embodiment of the present invention, showing the front and rear of the tab.

The present invention generally comprises a wallet organization system oriented around the use of tabs (10). The tabs (10) of the present invention are preferably equipped with a label (20), a first adhesive surface (30) and a second adhesive surface (40). Each of the tabs (10) of the present invention are removable, repositionable and also bendable in specific portions to retain the utility of the card. The adhesive covering of the first adhesive surface (30) and the second adhesive surface (40) is configured to be ink-proof, and as such, will not lift ink when the tab (10) is repositioned on a card. The second adhesive surface (40) is not necessarily present on all embodiments of the tab (10) of the present invention. The tab (10) of the present invention is applied to a card by pressing the adhesive portion on the first adhesive surface (30) (and the second adhesive surface (40) if needed) of the tab firmly onto the desired location on the card.

The body portion of the tab (10) is made of a transparent film preferably composed of acetate and a Mylar film material. These materials are employed as they are durable and stable, as well as non-tearing and non-yellowing in quality. The present invention is a high quality product to purchase by consumers, as it is durable, may be used and reapplied multiple times, and is attractive and unique for use in wallets.

The tab (10) of the present invention are preferably equipped with ribbed tips (90), which are preferably made of a rubber, silicone, or similar gripping material. The ribbed tips (90) are configured to facilitate the removal of the cards with the fingertips of the user, providing comfort as well as traction for the removal of the target card. The ribbed tips (90) of the present invention are preferably fashioned of a durable plastic material base. The ribbed tips (90) each have a raised, ribbed edge for easy finger-gripping and retrievablility. The ribbed tips (90), as well as the tab (10) itself are preferably equipped with the glow-in-the-dark element (100) of the present invention.

A label (20) of the tab (10) preferably includes a variety of specific pastel colors, consisting of blue, pink, yellow, green, and gray, helping to facilitate decorating and personalizing the tabs (10) to the taste of the user. The tabs (10) also expedite differentiation between all wallet cards and photos for ease of reference via personalization. This makes the present invention appealing to those who would find it fun in being creative with personalizing their tabs (10) for their wallet cards.

Additionally, the present invention also comes with available adhesive letters, numbers and specific design logos which the consumer can use to personalize the tabs attached to their wallet cards. These customization options are configured to adhere to the label (20) portion of each tab (10) of the present invention.

The adhesive at the bottom of the tab (10) is made of removable and reusable, double-sided adhesive material that can be used again and again on surfaces of all wallet cards. It is also photo-safe and great for use with photographs in photo albums. The adhesive material on the first adhesive surface (30) and the second adhesive surface (40) can be used repetitively, and is preferably strong enough to support up to 0.6 pounds, making the present invention a highly durable product for long-term use by the consumer.

Additionally, most embodiments of the present invention are equipped with a glow-in-the-dark element (100), which is preferably embedded into various portions of the tab (10), including, but not limited to the label (20), the body, and the ribbed tips (90) of the present invention. The glow-in-the-dark element (100) is preferably built-in to the mold of the plastic, and is not a glow-in-the-dark paint. However, some embodiments of the present invention may employ a glow-in-the-dark paint for light use. The glow-in-the-dark element (100) of the present invention enables use of the present invention in dark room settings, or outdoors at night. The glow-in-the-dark element (100) is configured to illuminate in the dark, which facilitates the rapid location and identification of the needed card. Additionally, the glow-in-the-dark element (100) enables the location of a card if it has been dropped on the floor inside a dark room, or outdoors at night.

The preferred embodiment of the present invention preferably is available in three primary sizes and forms including:

A) The Swiper Tab (50): The Swiper tab (50) is the standard sized tab (10) of the three primary embodiments, and is configured to be placed anywhere on the front surface of wallet cards. The Swiper tab (50) is specifically made for use with wallet cards that require swiping in ATM swiping machines, such as debit cards, credit cards, gift cards, driver licenses and the like. This will allow the secured information in the magnetic strip on the rear of the card to be read by conventional ATM machines in order to expedite account access. Additionally, the Swiper tab (50) has a bendable section near the bottom of the tab directly above the first adhesive surface (30). With the Swiper tab (50) of the present invention attached to the wallet card, the consumer folds down the bendable label (20) section of the tab while holding their card in the hand before swiping it in the machine, without removing the tab (10) from the card during this process. This allows the card to be swiped in the machine with full accessibility, and without interruption. Once the card is swiped, the label (20) may be bent back into place. A film extension (80) extends from the first adhesive portion (30) to the label (20) portion, providing for a place from which the label (20) may be bent out of the way to swipe the card at Point-of-Sale terminals. The first adhesive portion (30) of the swiper tab (50) may also be equipped with a logo or marking.

It should be noted that the only occasion that the Swiper tab (50) must be removed from the card is when it is necessary to insert a card into the bank vault of an ATM, and upon removing the tab following this process, the user may simply place the tab (10) back into position on the card. The adhesive on the first adhesive surface (30) and second adhesive surface (40) on the tab (10) is preferably of such durable quality that the tab may be removed, repositioned, and placed back onto the card numerous times, and can be used repeatedly this way for several years. Thus, the present invention is preferably durable, making it a wise and usable product to purchase by the consumer for its function and quality.

Figure 4:
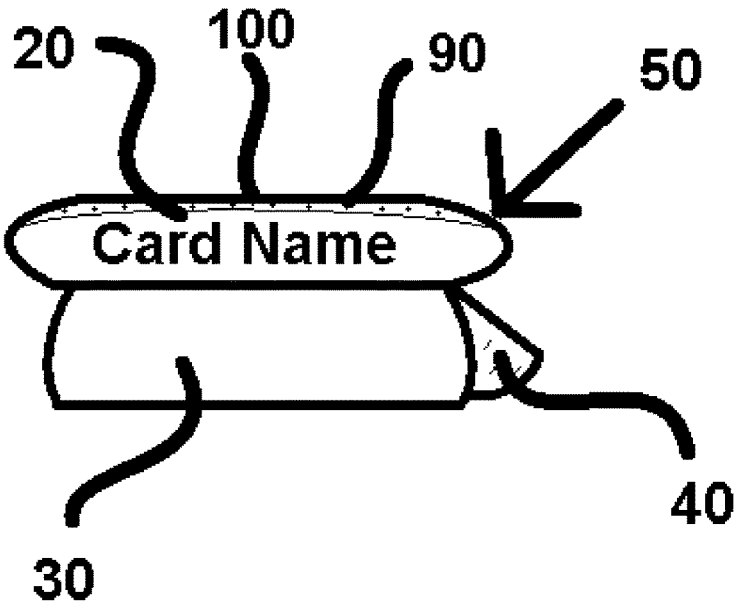
FIG. 4 displays a view of the front of the Big Buddy Tab of the present invention.
Figure 5:
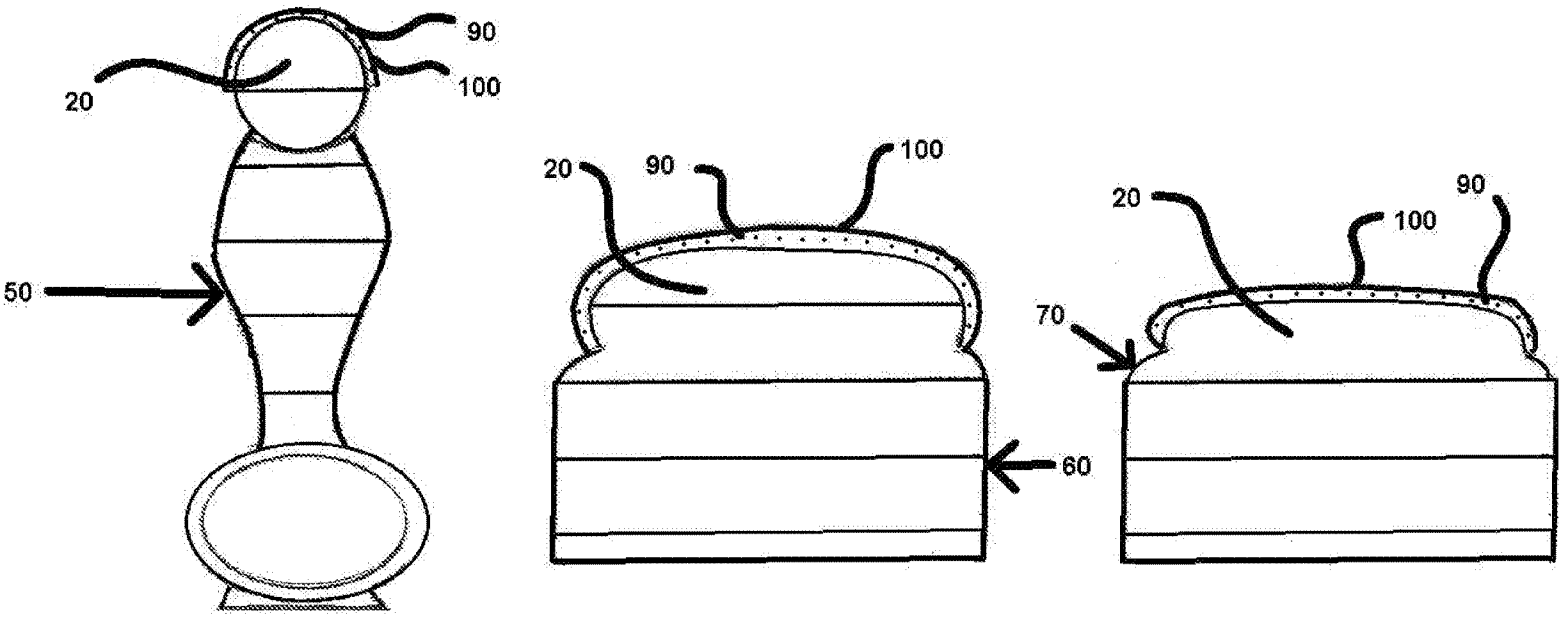
FIG. 5 details a view of each of the tabs of the system of the present invention, showing the glow-in-the-dark portions, as well as the ribbed tip portions of the present invention.

B) The Big Buddy tab (60) is the larger size tab disclosed in FIG. 4, and is configured to be placed on the back surface of all other wallet cards that do not require any swiping, such as all business cards and photos, or other types of Ids that are not to be swiped in a machine.

Figure 3:
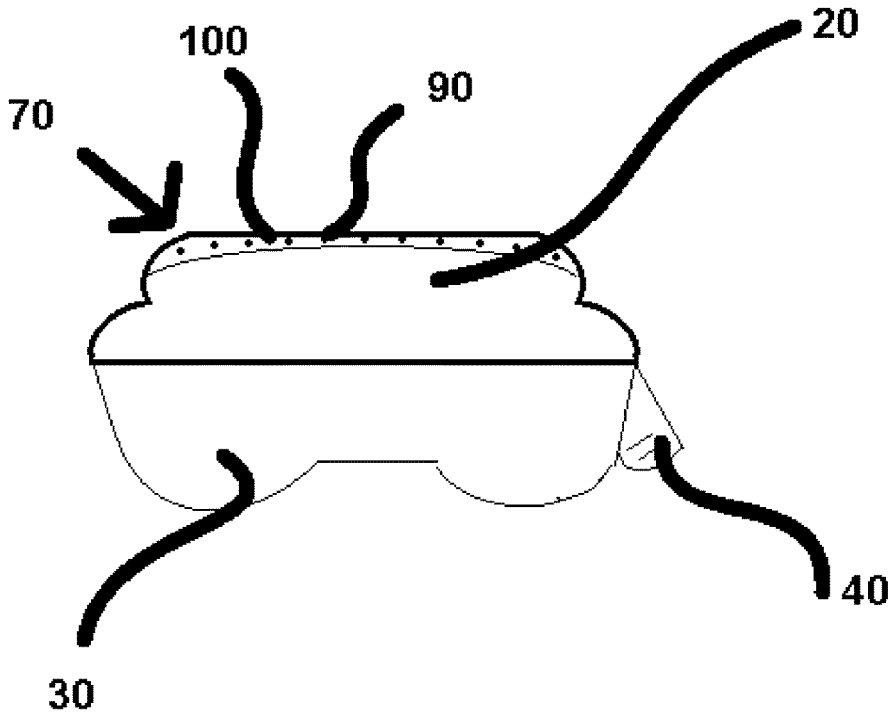
FIG. 3 exhibits a view of the front of the Tight-Fit tab embodiment of the present invention, as seen from the front.

C) The Tight Fit Tab (70) is the smallest size tab, which is disclosed in FIG. 3. The tight fit tab (70) is configured to adhere to a card to be placed in a slim-line, narrow, or otherwise tight-fitting card slot or pocket of a wallet. As such, the tight fit tab (70) is similar in body size and use to the big buddy tab (60), with the exception that the label (20) portion is smaller, providing for the use of the tight fit tab (70) in tight spaces where the card slots leave no room to accommodate the big buddy tab (60). The tight fit tab (70) may be affixed to the long or short sides of the card, and is equipped with a smaller label (20) portion, while still providing ample space to grip the tight fit tab (70). The tight fit tab (70) is preferably red in color, easily differentiating it from other tabs (10).

The label (20), disposed at the top or tip portion of the tab, is shaped differently for each of the three primary embodiments of the present invention. For example, the Swiper tab (50) has a round label portion, thereby giving the total appearance of the tab (10) a shape similar to that of a pawn chess piece.

Special instructions for use of all three types of tab (10) of the present invention include:

1) When removing the tab (10) from the surface of the card, the adhesive portion is to be peeled off slowly and gently from its surface, and the user should avoid pulling the tab straight out from the surface. This preserves the stickiness of the adhesive section of the tab. The present invention may lose its adhesive efficacy with repetitive use and/or exposure to dust particles to the first adhesive surface (30) and/or second adhesive surface (40) on either embodiment of the present invention. To resolve this issue, the tabs (10) may be gently washed on the first adhesive section (30) and second adhesive portion (40) of the tab with soapy water, rinse, air-dry, and reuse.

The preferred measurements of the three embodiments of the present invention are preferably as follows:

A) The smaller Swiper tab (50) preferably measures three inches in height, and two centimeters in width. The first adhesive section (30) for this tab is also preferably two centimeters in width and one and a half centimeters in height.

B) The larger Big Buddy tab (60) preferably measures four centimeters in height and two inches in width. The second adhesive section (40) for this tab (10) is also preferably two inches in width and one centimeter in height. The big buddy tab (60) preferably has a curved label portion, similar in shape to a bread slice.

C) The low-profile Tight Fit Tab (70) preferably measures three centimeters in height, with a variable width according to the needs of the user. The tight fit tab (70) preferably has a curved label (20) portion, similar in shape to a low-profile bread slice. The first adhesive section (30) of the tight fit tab (70) is preferably two inches in width and one centimeter in height.

Additionally, a "Wallet Buddy" logo is preferably featured on the front or rear of the label (20) of the present invention. The logo is preferably disposed on the front surface of the label for customers who do not wish to personalize their tabs (10).

It should be noted that the ribbed tips (90) of the swiper tabs (50) of the present invention is preferably 0.2 cm in width, and 0.2 cm in height (thickness). In the larger big buddy tab (60), the ribbed grip area of the ribbed tips (90) is preferably 4.5 cm in width, and 0.2 cm in height. Additionally, the ribbed grip area of the ribbed tip (90) of the tight-fit buddy tab (70) is preferably 4.0 cm in width and 0.2 cm in height. However, it is envisioned that alternate embodiments of the present invention may employ differing dimensions of the ribbed tips (90), so long as portions of the ribbed tips (90) are raised such that they extend outwards from the tips. Similarly, it is envisioned that the pattern of the ribbing of the ribbed tips (90) may vary in order to facilitate access to the wallet cards without a direct line of sight. Alternate embodiments of the ribbed tips (90) can assist sight-impaired individuals in wallet card identification and location as well.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A system for facilitating the removal of at least one wallet card from a wallet comprising:

at least one tab, said at least one tab equipped with a film extension, a label, a ribbed tip, and an adhesive portion;

wherein said ribbed tip is in communication with said label;

wherein said film extension extends between said label and said adhesive portion;

adhesive, said adhesive disposed on said adhesive portion;

wherein said adhesive is configured to adhere said adhesive portion to a point of attachment on a bottom of the at least one wallet card;

wherein said at least one tab extends across the at least one wallet card via said film extension to said point of attachment;

wherein said film extension is long enough to extend completely across the at least one wallet card;

wherein said at least one tab has a front and a back;

wherein said adhesive of said adhesive portion is removably in communication with the wallet card at said point of attachment, wherein said film extension is configured to be bent down and away from the wallet card from its original position via the ribbed tip when a swipe of the wallet card is required; and wherein said film extension is configured to return to its original position after swiping of the wallet card.

2. The system of claim 1, wherein said label indicates the title of the wallet card.

3. The system of claim 1, wherein said first adhesive portion is equipped with a logo.

4. The system of claim 1, wherein said adhesive is reusable.

5. The system of claim 1, wherein said label is customizable.

6. The system of claim 1, wherein said label is colored.

7. The system of claim 1, wherein said film extension and said adhesive portion are made of plastic film material.

8. The system of claim 1, wherein said at least one tab is a swiper-tab configured for use on wallet cards having a magnetic swipe strip.

9. The system of claim 1, further comprising:

a glow-in-the-dark element; and wherein said glow-in-the-dark element is embedded within said label.

10. The system of claim 1, further comprising:

ribbed tips, said ribbed tips disposed on said gripping edge; and wherein said ribbed tips are equipped with raised ribbing for ease of grip.

11. The system of claim 10, further comprising:

a glow-in-the-dark element; and wherein said glow-in-the-dark element is embedded within said ribbed tips.

12. A system for facilitating the removal of at least one wallet card from a wallet comprising:

at least one tab, said at least one tab equipped with a film extension, a first adhesive portion, and a second adhesive portion;

wherein said film extension is equipped with a label;

wherein said label indicates the title of the wallet card;

wherein said first adhesive portion is equipped with a logo;

adhesive, said adhesive disposed on said first adhesive portion and said second adhesive portion;

wherein said adhesive of said first adhesive portion mirrors that of said adhesive of said second adhesive portion;

wherein said at least one tab has a front and a back;

wherein said first adhesive portion is on said back of said at least one tab;

wherein said second adhesive portion is on said back of said at least one tab;

wherein said adhesive is reusable;

wherein said label is customizable;

wherein said label is colored;

wherein said adhesive of said first adhesive portion and said second adhesive portion are removably in communication with the wallet card; and wherein said film extension is configured to be bent away from the wallet card when a swipe of the wallet card is required.

* * * * *